United States Patent [19]

Off

[11] 4,321,710

[45] Mar. 30, 1982

[54] POCKET CONSTRUCTION

[75] Inventor: Joseph W. A. Off, Irving, Tex.

[73] Assignee: Haggar Company, Dallas, Tex.

[21] Appl. No.: 138,080

[22] Filed: Apr. 7, 1980

Related U.S. Application Data

[63] Continuation of Ser. No. 42,333, May 25, 1979, abandoned, which is a continuation-in-part of Ser. No. 905,054, May 11, 1978, Pat. No. 4,156,293, which is a continuation of Ser. No. 819,843, Jul. 28, 1977, abandoned.

[51] Int. Cl.[3] ..... A41D 27/20

[52] U.S. Cl. ..... 2/247

[58] Field of Search ..... 2/247, 243 R, 243 A, 2/243 B, 248, 249, 250, 251, 252, 253, 254

[56] References Cited

U.S. PATENT DOCUMENTS

| | | | |
|---|---|---|---|
| 1,832,214 | 11/1931 | Jenkins . | |
| 2,011,958 | 8/1935 | Vizard . | |
| 2,282,545 | 5/1942 | Rosenstein . | |
| 2,403,694 | 7/1946 | Vizard . | |
| 2,709,815 | 6/1955 | Nelson | 2/247 |
| 2,840,824 | 7/1958 | Horner | 2/247 |
| 3,137,865 | 6/1964 | Evans . | |
| 3,168,749 | 2/1965 | Cala . | |
| 3,451,065 | 6/1969 | Augustin . | |
| 3,540,975 | 11/1970 | Wright . | |
| 3,560,292 | 2/1971 | Butter . | |
| 3,564,615 | 2/1971 | Jacobsen . | |
| 3,719,955 | 3/1973 | Hrubecky . | |
| 3,725,959 | 4/1973 | Cruden . | |
| 3,794,554 | 2/1974 | Caring . | |
| 3,840,901 | 10/1974 | Eyster | 2/247 |
| 3,861,974 | 1/1975 | Trombly . | |
| 3,881,041 | 4/1975 | Glienke . | |
| 4,263,678 | 4/1981 | Off | 2/247 |
| 4,266,300 | 5/1981 | Partridge | 2/247 |

*Primary Examiner*—Peter P. Nerbun

*Attorney, Agent, or Firm*—Richards, Harris & Medlock

[57] ABSTRACT

In a method of constructing pockets, a pocket blank is preferably folded first along both longitudinal edges, and then transversely so that the edges are inside the two resultant pocket panels. The inner pocket panel is adhesively secured to the inside of a garment, followed by formation of a slit of predetermined shape in the adhesive connection therebetween. The edges of the slit are then folded back and adhesively secured to produce a pocket slot. Preferably, a pocket welt is secured next across the bottom of the slot. If desired, another welt or a pocket flap can be secured across the top of the slot followed by placement of a facing strip thereover. Stitched bar tacks are then provided adjacent the slot, after which the pocket panels are closed and sealed to complete construction of the pocket.

In another embodiment, a pocket blank is positioned beneath a pocket opening formed in the garment panel. The lower edge of the opening is then folded back and adhesively secured to one end of the pocket blank. If desired, a stitch can be added to reinforce interconnection of the garment and pocket blank. A facing strip is attached near the other end of the pocket blank so that the strip covers the pocket opening after the pocket blank is transversely folded and sealed to complete construction of the pocket.

37 Claims, 33 Drawing Figures

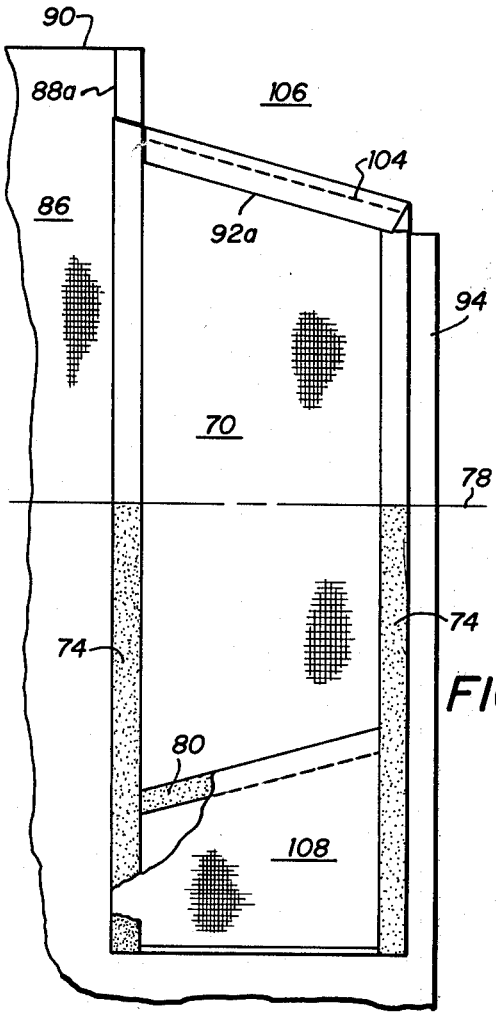
FIG. 23
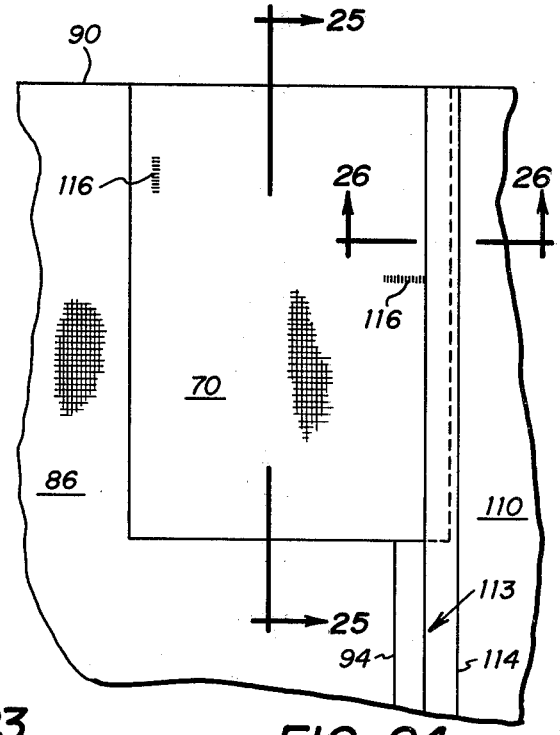
FIG. 24
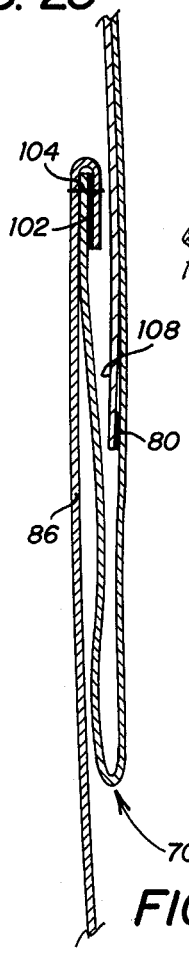
FIG. 25
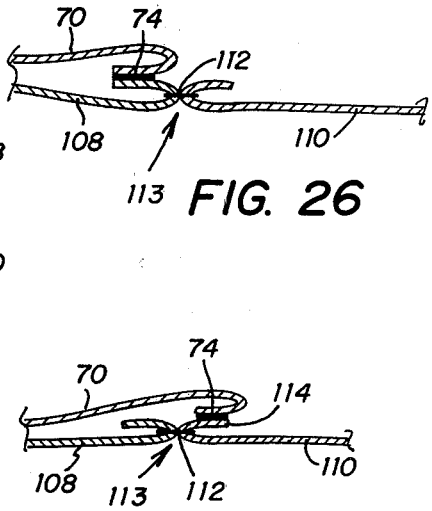
FIG. 26
FIG. 27
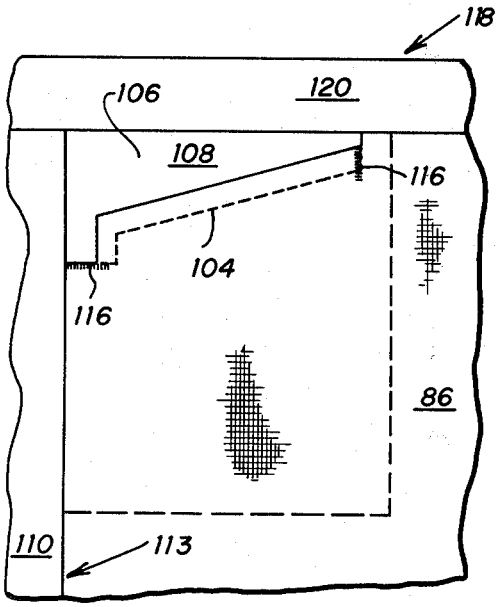
FIG. 28

POCKET CONSTRUCTION

CROSS REFERENCE TO RELATED APPLICATIONS

This is a continuation of application Ser. No. 06/042,333, filed May 25, 1979, now abandoned, which is a continuation-in-part of co-pending application Ser. No. 905,054 filed May 11, 1978, now U.S. Pat. No. 4,156,293, which is a continuation of application Ser. No. 819,843 filed July 28, 1977, abandoned.

BACKGROUND AND SUMMARY OF THE INVENTION

The present invention relates generally to a method of making pockets, and more particularly to a method of making pockets in any garment requiring pockets.

In the manufacture of garments, pockets are provided chiefly as a convenient means for carrying useful articles. Such useful items may include, for example, currency, change, keys, a wallet, a handkerchief and so forth. The pockets are integrated into the garment and take the general form of a pouch open at one end to permit easy access to the contents.

Two basic types of pocket construction are used. In the patch-type pocket, a layer or patch of material is attached directly to the outside surface of the garment. The path pocket is usually sewn only at the side and bottom edges so that articles can be received between the garment and pocket layers through the unsecured upper end. Patch pockets are thus easily constructed and attached to the garment, and are utilized most popularly in garments having less formal or leisure applications. In contrast to the patch-type pocket, the standard pocket is positioned on the inside of the garment. A slot in the garment permits access to the standard pocket. Consequently a standard pocket occupies a hidden, protected location in the garment, which therefore presents a much neater, finished appearance. However, construction of the standard pocket requires numerous manual operations including material cutting, positioning, sewing and trimming. These manual operations are time consuming and therefore expensive in terms of both labor and material expenditure.

The present invention comprises a method of constructing pockets in garments which overcomes the foregoing and other problems long since associated with the prior art. In accordance with the broader aspects of the invention, a length of pocket material is folded to provide two pocket panels interconnected by a fold with the obverse sides thereof facing inwardly. Preferably, portions of both longitudinal edges of the folded pocket are adhesively secured in one embodiment of the invention before securing the inner pocket panel to the inside surface of the garment. A pocket slot is then formed in the garment and selected components of the pocket are then assembled before adhesively securing the remaining peripheries of the pocket panels. In another embodiment, a pocket blank is positioned beneath a pocket opening formed in the garment panel before the edge thereof is folded back and adhesively secured to the pocket blank. By these methods, garment pockets are constructed from the interior of the garment with a minimum number of manual operations.

In accordance with more specific aspects of the invention, a length of material defining a pocket blank is first provided. Preferably, three areas of fusible adhesive material are located on the same side of the pocket blank; along portions of both longitudinal edges, and transversely in a strip near one end thereof. The pocket blank is first folded along the longitudinal edges, and later transversely so that each folded edge portion having fusible adhesive material thereon is adjacent the remaining portion of the same folded edge.

Alternatively, the areas of fusible adhesive material can be provided on opposite sides of the pocket blank; along portions of both longitudinal edges on the obverse side, and transversely in a strip near one end of the reverse side. Such a pocket blank is simply folded transversely in order to overlap each adhesive edge portion.

In accordance with the preferred construction, the fusible adhesive material in the vicinity of the fold interconnecting the inner and outer pocket blank panels is then activated to adhesively secure the bottom section of the pocket. Preferably, activation of the fusible adhesive material is accomplished by engaging the pocket blank with a heated press, ultrasonic means, or a radiant source capable of converting the adhesive from solid to plastic state.

After the pocket blank panels have been folded and adhesively secured in part, the inner pocket panel is adhesively secured to the inside surface of the garment by activating the transverse strip of fusible adhesive material. A slit, from which the pocket opening is constructed, is then formed through the adhesive connection between the garment and inner pocket panel. Depending upon the particular type of pocket desired, any of several welt, flap and facing strip combinations can be adhesively secured across or within the pocket opening. Stitched bar tacks are then provided at each end of the pocket opening to mechanically interconnect the garment, inner pocket panel and selected pocket components. At this juncture, the internal assembly of the pocket can be inspected before closing and adhesively securing the remaining section of the outer pocket panel to the inner pocket panel to complete the pocket construction.

According to another embodiment of the invention, a pocket blank is positioned on the inside surface of a garment panel beneath a pocket opening formed therein. The pocket blank is substantially similar to that employed in the first inventive embodiment, except that one end thereof is trimmed to correspond with the lower edge of the particular pocket opening. The lower edge of the opening is then folded back and adhesively secured to the pocket blank. If desired, a stitch can be added along the edge of the pocket opening to reinforce interconnection of the pocket blank and garment panel.

A facing strip is then positioned to cover the pocket opening when the pocket blank is later folded transversely to form inner and outer pocket panels. Preferably, the facing strip is attached to the lower end of the pocket blank so that the strip is properly positioned upon folding of the pocket blank. Construction of the pocket is completed by adhesively securing the remaining periphery of the folded pocket blank. Stitched bar tacks can be provided at the ends of the pocket opening to mechanically interconnect the garment and pocket, if desired.

DESCRIPTION OF THE DRAWINGS

A more complete understanding of the invention may be had by reference to the following Detailed Description when taken in conjunction with the accompanying Drawings, wherein:

FIGS. 21-24 are illustrations of steps in the pocket construction method according to the second embodiment of the invention;

FIGS. 25 and 26 are sectional views taken along lines 25—25 and 26—26 of FIG. 23 in the direction of the arrows;

FIG. 27 is a sectional view similar to FIG. 26;

FIG. 28 is an illustration of the outside surface of a garment after completion of the pocket.

DETAILED DESCRIPTION OF THE INVENTION

Figure 1:
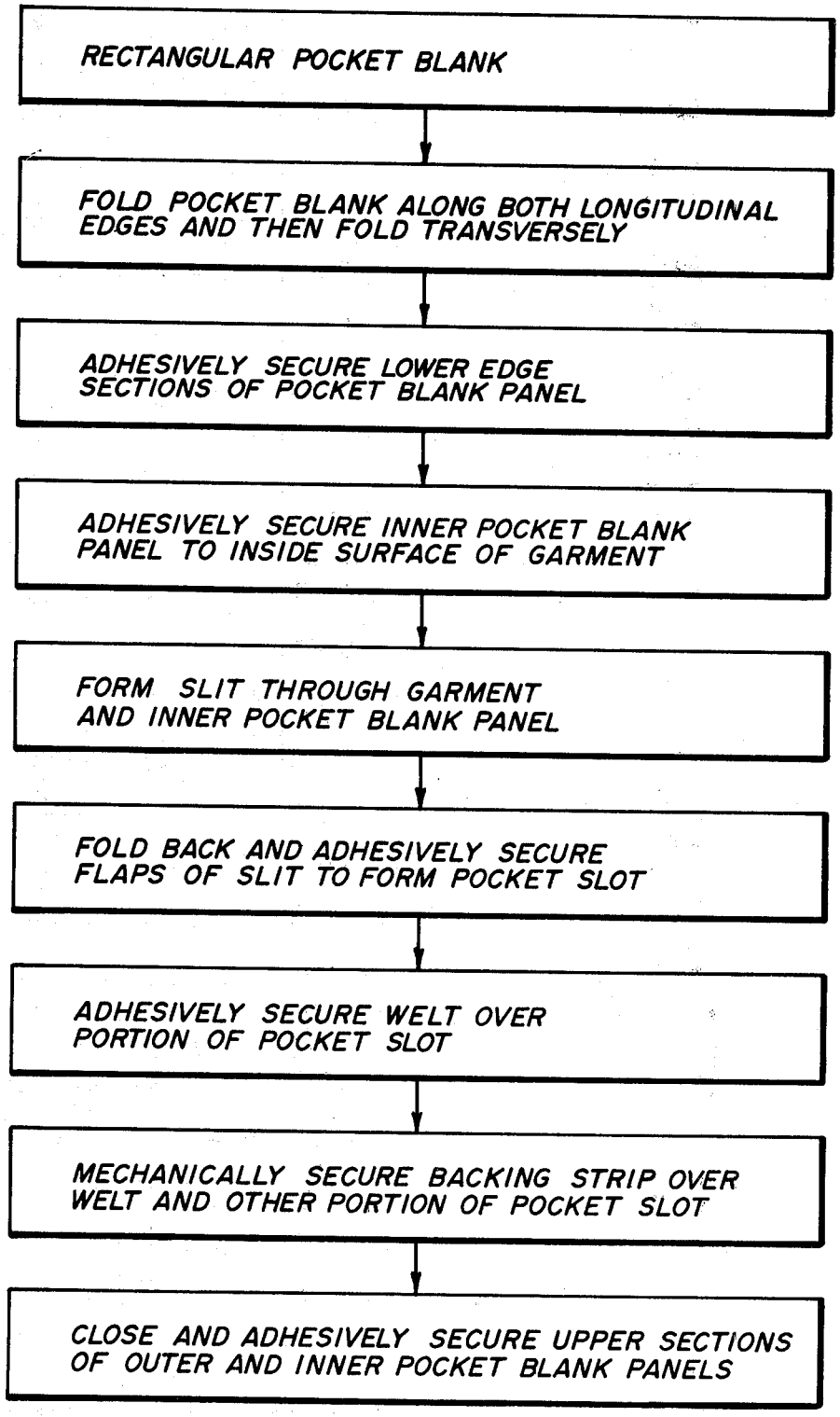
FIG. 1 is a block diagram illustrating a method of constructing pockets for garments incorporating the invention.

Referring now to the Drawings, and particularly to FIG. 1 thereof, there is illustrated a method of constructing pockets incorporating the invention. The method includes the utilization of fusible adhesive materials to eliminate many heretofore required time consuming and costly manual operations in pocket construction. The method of the invention can be used in the manufacture of any garment utilizing pockets. Use of the method results in a strong, durable pocket construction of pleasing appearance.

Figure 2:
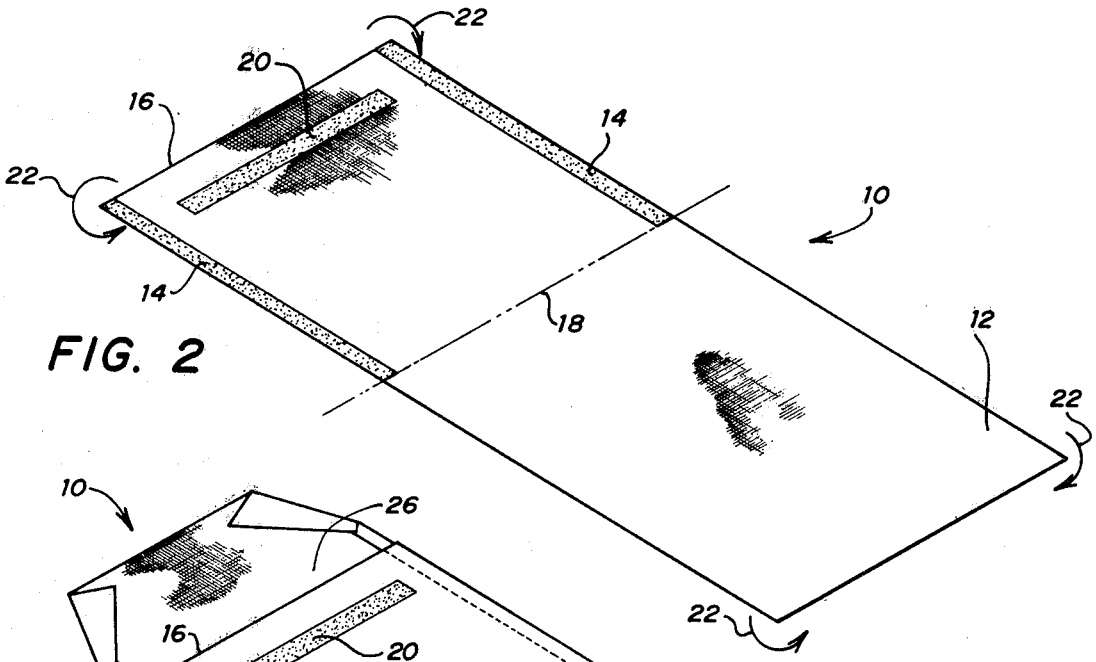
FIG. 2 is an illustration of a length of pocket material useful in forming a pocket blank.

Referring particularly to FIG. 2, there is shown a pocket blank 10 useful in the practice of the invention. Pocket blank 10 is depicted in a flat, unfolded initial condition with the reverse side up. Pocket blank 10 is formed from a length of pocket material 12 having sufficient overall dimensions to allow construction of a pocket having predetermined depth and width. Material 12 can comprise any natural or synthetic cloth material suitable for use in pocket construction. It will be understood that the exact composition of pocket material 12 is not critical to the practice of the invention.

In particular, pocket blank 10 comprises a rectangular piece of pocket material 12 having adhesive areas 14 located adjacent part of both longitudinal edges of the reverse side thereof. Adhesive areas 14 can be formed by attaching a thin layer of fusible adhesive material to the selected locations. The fusible material is preferably thermally responsive and may comprise ribbons or strips of extruded polyamide, nylon or polyester materials of the type manufactured by General Fabric Fusing Company of Cincinnati, Ohio. If desired, the fusible adhesive could be extruded directly onto pocket material 12. Adhesive areas 14 are of predetermined width and length, extending from upper end 16 to fold line 18 on material 12. Preferably, pocket blank 10 also includes a transverse adhesive area 20 positioned in spaced, parallel relationship near end 16 and across the reverse side of pocket blank 10. It will thus be apparent that adhesive areas 14 and 20 are formed by applying strips of fusible adhesive material to the same side of pocket material 12.

Figure 3:
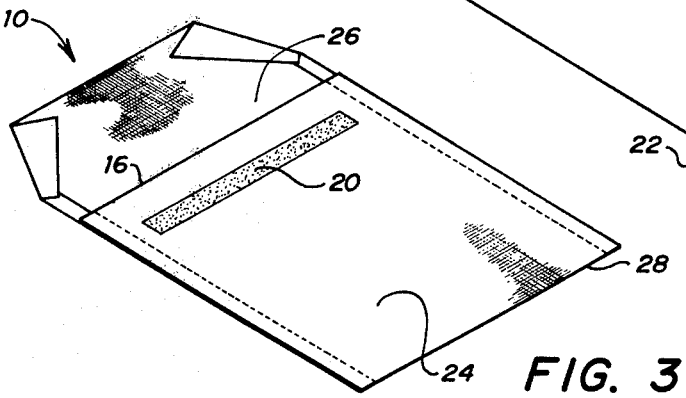
FIG. 3 is an illustration of the pocket blank shown in FIG. 2 after folding.

Two successive folding steps are then undertaken. The longitudinal edges of pocket blank 10 are first folded inwardly in the directions of arrows 22 in FIG. 2. After this folding step, adhesive areas 14 face the same direction as an obverse side, while adhesive area 20 remains oriented in the reverse direction. Thus, the edge portions of pocket blank 10 face in a direction opposite the original direction. After the folding of both longitudinal edges, pocket blank 10 is folded transversely along fold line 18. As is best shown in FIG. 3, pocket blank 10 now comprises inner panel 24 and outer panel 26 interconnected at one end by fold 28. It will thus be apparent that after the longitudinal and transverse folding operations, adhesive areas 14 extend continuously between end 16 and fold 28 within the adjacent, folded longitudinal edges of panels 24 and 26. Moreover, all raw edges are turned inwardly and are therefore concealed.

With the pocket blank 10 folded as shown in FIG. 3, activation of the fusible adhesive material between the adjacent longitudinal edges of panels 24 and 26 next occurs. Activation of the adhesive material is preferably accomplished by engaging heated means (not shown) with outer panel 26 of pocket blank 10. The means for activating the adhesive may comprise; for example, a heated press, ultrasonic or microwave means, or a radiant source capable of converting the adhesive from a solid to a plastic state. The temperature generated by and duration of engagement of the activating means are sufficient to melt the desired portions of adhesive areas 14, whereby the edges of pocket blank 10 are permeated with melted adhesive to become bonded together. It will be appreciated that use of a heated press activating the fusible adhesive material to secure the edges of panels 24 and 26 would simultaneously function to press any wrinkles or folds in the edge portions. Furthermore, it will be understood that this means of adhesive connection is strong and durable as well as resistant to garment cleaning processes. Preferably, only a portion of each adhesive area 14 in the vicinity of fold 28 is initially activated. Thus, only the lower edge sections of folded pocket blank 10 are adhesively secured at first. This allows the upper section of outer panel 26 to be laid back exposing part of the pocket interior.

Figure 10:
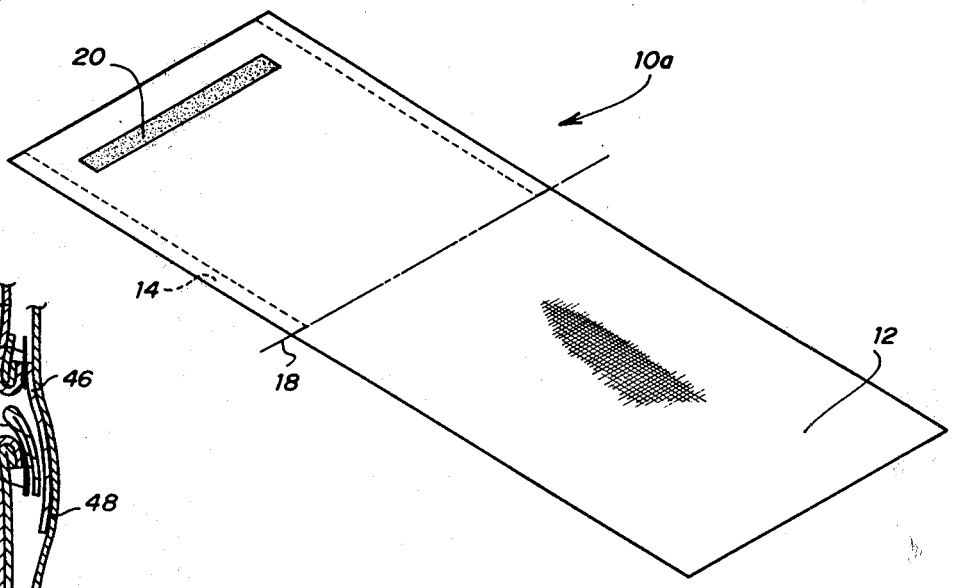
FIG. 10 is an illustration of an alternative to the pocket blank shown in FIG. 2.

Referring momentarily to FIG. 10, there is shown an alternate pocket blank 10*a* which could be substituted for pocket blank 10. Pocket blank 10*a* differs from pocket blank 10 primarily by virtue of the fact that adhesive areas 14 and 20 are located on opposite sides of the length of material 12, rather than on the same side. This eliminates the step of inwardly folding the longitudinal edges prior to the transverse folding operation. With pocket blank 10*a*, it is necessary only that material 12 be transversely folded along fold line 18 so that adhesive areas 14 are inside the resultant panels 24 and 26. It will be appreciated that a relatively narrower length of material 12 can be formed into pocket blank 10*a*, which results in material savings and therefore cost savings. Pocket blank 10*a* might be used, for example, in an inexpensive garment since the exposed edges result in a less finished appearance. Raveling of the edges is prevented, however, by adhesive permeation of material 12 in areas 14 after activation.

While it is preferably that the steps of transversely folding the pocket blank 10 and then adhesively securing the lower edge sections thereof be carried out at this stage of the invention, it will be understood that these steps can occur later without departing from the spirit and scope of the invention. For instance, these steps could take place after the pocket blank 10 is attached to the garment, or after other subsequent steps.

Figure 4:
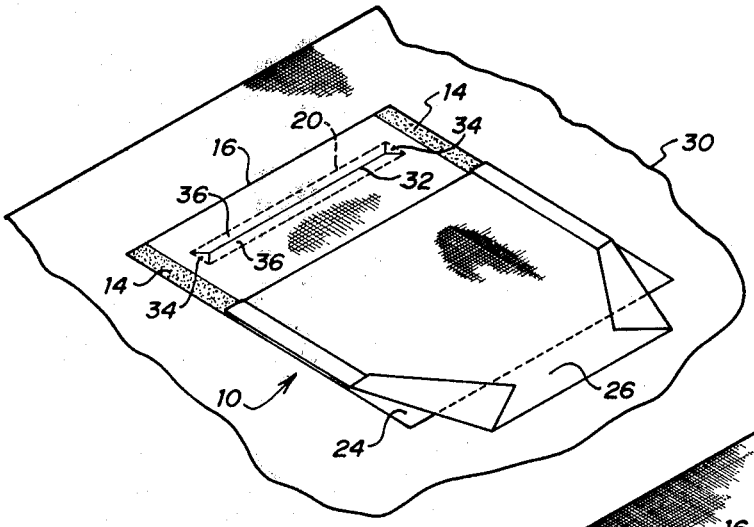
FIG. 4 is an illustration of the folded pocket blank positioned on the inside of a garment panel.

With a section of upper panel 26 laid back as shown in FIG. 4, the folded pocket blank 10 is then positioned on the inside surface of a garment 30 wherein the pocket is desired. The material of garment 30 can comprise any natural or synthetic cloth, the exact composition of which is not critical to the practice of the invention. In particular, the reverse side of panel 24 is placed downward with adhesive area 20 situated over the area in which the pocket slot will be formed. It will be recalled that the placement of adhesive area 20 on pocket blank 10 is preferred but not required in the practice of the invention. Alternatively, in the absence of adhesive area 20 on pocket blank 10, a corresponding adhesive area initially formed on garment 30 at the location of the pocket slot to be formed can be utilized, if desired. With the folded pocket blank 10 thus positioned, the fusible material of adhesive area 20 is activated to adhesively secure folded pocket blank 10 to garment 30.

Following the step of adhesively securing pocket blank 10 to garment 30, a transverse slit 32 is formed through garment 30, activated adhesive area 20 and inner panel 24. Slit 32 is thus made through the adhesive connection between pocket blank 10 and garment 30 so that the edges formed thereby are not unattached but are bonded together. The preferred configuration of slit 32 includes Y-shaped ends. This particular slit configuration is most important because two sets of opposing flaps, flap sets 34 and 36, are so formed.

Figure 5:
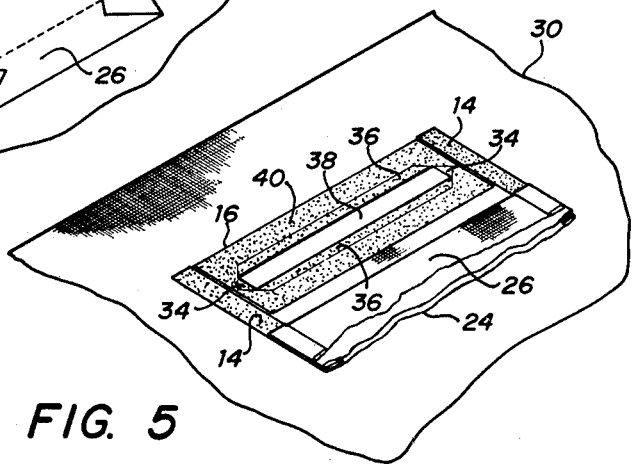
FIGS. 5, 6, and 7 are illustrations of successive steps in a method of constructing pockets in accordance with the invention.

Having made slit 32, the flap sets 34 and 36 are folded inwardly against the obverse side of inner panel 24 of pocket blank 10 as shown in FIG. 5. This exposes a rectangular opening though garment 30 and one panel of pocket blank 10 which will serve as pocket slot 38. Flap sets 34 and 36 must then be secured in their folded back positions.

The flap sets 34 and 36 are secured down with adhesive strip 40. In accordance with one construction, strip 40 comprises a rectangular piece of fusible adhesive including a cutout area corresponding to pocket slot 38. Adhesive strip 40 is laid over flap sets 34 and 36 in surrounding relationship with slot 38. It will be apparent that more than one separate adhesive strip can be positioned over flap sets 34 and 36 adjacent slot 38, if desired. It will be appreciated that adhesive strip 40, or its equivalent, could be extruded directly over flap sets 34 and 36, if desired. Adhesive strip 40 preferably consists of a piece of extruded adhesive material carried on one side of a backing layer (not shown). By this means, adhesive strip 40 is laid with the adhesive side downward. The fusible adhesive material of strip 40 can then be activated to secure flap sets 34 and 36 in place. Following activation of adhesive strip 40, the backing (not shown) can then be peeled away to expose the top side of the adhesive strip. At this point it will thus be apparent that adhesive areas surround pocket slot 38.

To achieve a pocket construction of the desired type and finish, one or more pocket welts, a pocket flap, a facing strip, or combinations thereof are next attached. The materials of these pocket components may comprise any natural or synthetic cloth, the exact composition of which is not critical to the practice of the invention. If desired, any of these pocket components can comprise a material matching the garment 30. Depending upon the style or fashion, a welt could also be formed of a material contrasting with garment 30.

Figure 6:
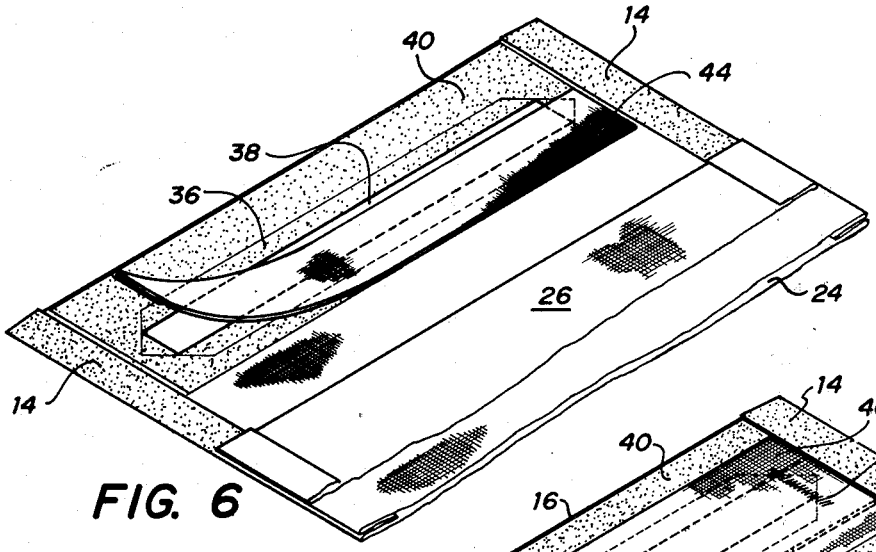

If desired, a welt 44 is first laid over the lower edge of pocket slot 38 and a portion of adhesive strip 40 as shown in FIG. 6. Welt 44 preferably comprises a relatively narrow piece of folded material with sufficient length to span panel 24 between adhesive areas 14. The folded edge of welt 44 is positioned across slot 38 to provide a finished appearance to the pocket opening. The fusible material comprising adhesive strip 40 is then activated to secure welt 44 to panel 24.

Figure 7:
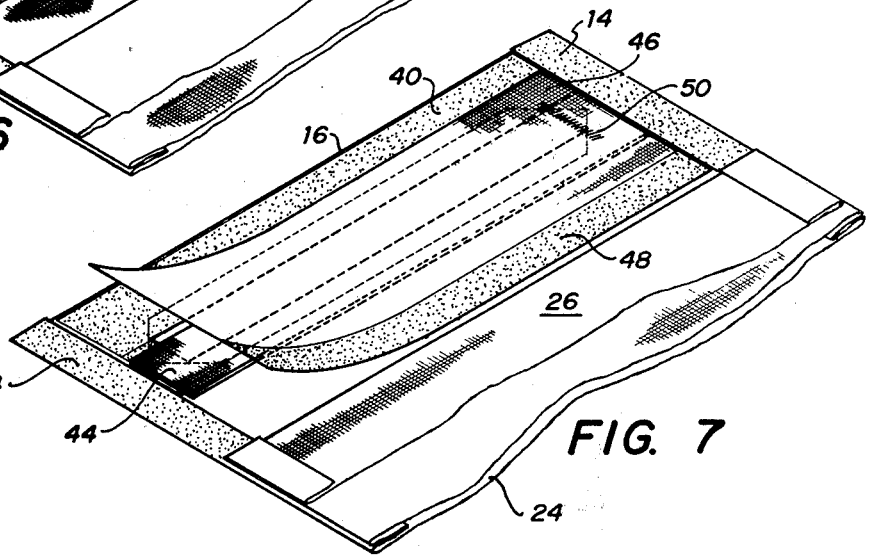
Figure 9:
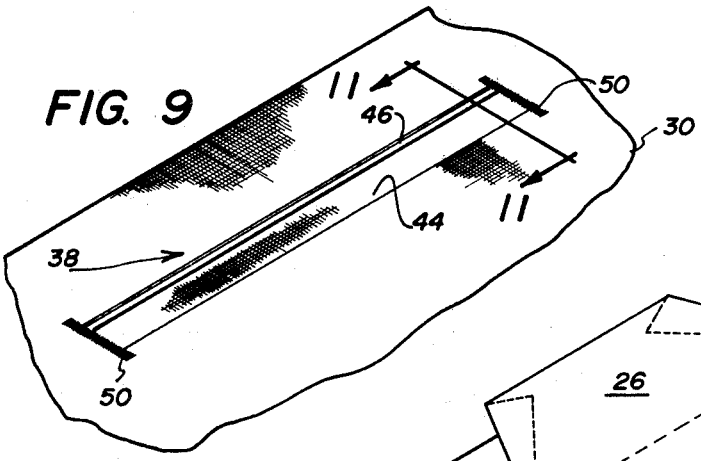
FIG. 9 is an illustration of the outside surface of a garment having a pocket formed in accordance with the invention.

If desired, a pocket facing strip can then be laid over welt 44 and the remaining portion of pocket slot 38 as shown in FIG. 7. Preferably, facing strip 46 is of sufficient width to cover welt 44 and pocket slot 38 without entirely covering the portion of adhesive strip 40 between slot 38 and end 16. Thus, the remaining exposed portion of adhesive strip 40 can be subsequently used to adhesively secure the ends of pocket panels 24 and 26. It will be apparent that a wider facing strip 46 covering the upper section of adhesive strip 40 could be utilized. A wider facing strip 46 would preferably include an adhesive area (not shown) along the upper end of the outside surface thereof, by which outer pocket panel 26 would be adhesively secured to facing strip 46 which would be adhesively secured in turn to inner pocket panel 24. As shown in FIG. 7, facing strip 46 preferably includes adhesive area 48 along the lower end of the outside surface thereof. Adhesive area 48 comprises a layer of fusible adhesive material which will be utilized subsequently to secure outer pocket panel 26 to strip 46.

It will be appreciated that the pocket construction can include a facing strip 46 without welt 44. In the event a facing strip 46 alone is desired, a strip of material (not shown) should first be placed between the lower sections of facing strip 46 and adhesive strip 40 to act as a buffer. Such a buffer strip (not shown) would be required to prevent facing strip 46 from becoming adhesively secured in surrounding relationship with pocket slot 38. Access to the interior of the pocket construction would therefore be maintained.

After positioning of pocket welt 44 and/or pocket facing strip 46, stitched bar tacks 50 are added at each end of pocket slot 38. Tacks 50, only one of which is shown in FIG. 7, serve to mechanically interconnect garment 30, inner pocket panel 24, and the desired pocket components. Tacks 50 also help secure flap set 34 in a folded inward configuration. Thus, tacks 50 function to reinforce the pocket construction, and further serve to lend a handmade appearance to the outside of garment 30. As shown, tacks 50 mechanically interconnect garment 30, panel 24, welt 44, and facing strip 46.

Figure 8:
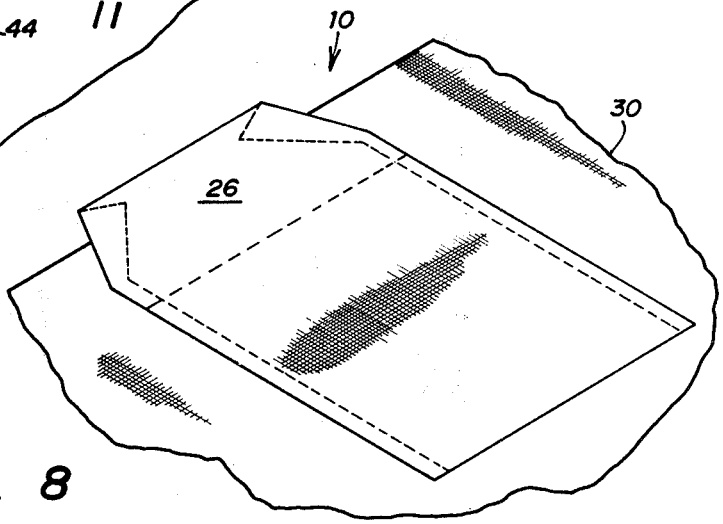
FIG. 8 is an illustration of the inside surface of a garment having a pocket formed in accordance with the invention.
Figure 11:
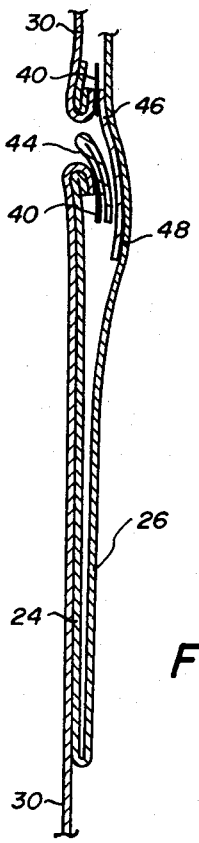
FIG. 11 is a sectional view taken generally along lines 11—11 in FIG. 9.

Subsequent to the placement of tacks 50, the interior assembly of the pocket can be inspected before closing panel 26 and activating the remaining adhesive areas to seal the upper section of the folded pocket blank 10. With panel 26 closed as shown in FIG. 8, activation of adhesive area 48, the remaining portions of adhesive areas 14 and adhesive strip 40 completes the pocket construction. A cross section of a finished, single welt pocket constructed in accordance with the invention is shown in FIG. 11. The pocket shown in FIG. 11 includes optional stitch 45.

Figure 12:
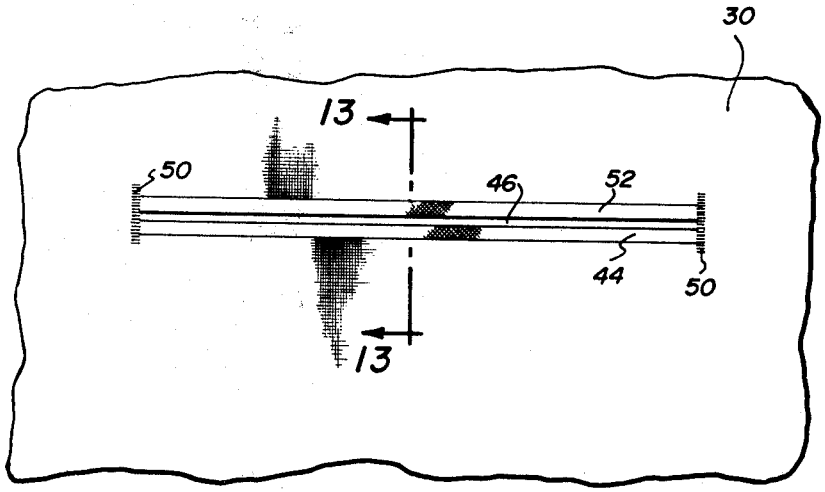
FIG. 12 is an illustration of the outside surface of a garment having a pocket formed in accordance with a first modification of the invention.
Figure 13:
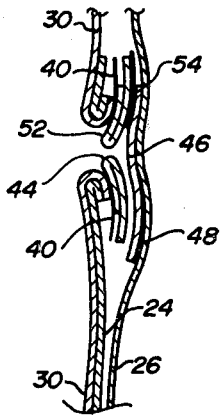
FIG. 13 is a partial sectional view taken generally along lines 13—13 in FIG. 12.

Turning now to FIGS. 12 and 13, the step of attaching a second pocket welt 52 as shown can be included in the invention. In particular, second welt 52 is laid over adhesive strip 40 so as to extend across the upper edge of pocket slot 38. This step can be carried out either before or after the placement of first welt 44, but prior to the placement of facing strip 46. The fusible material comprising adhesive strip 40 is then activated to secure second welt 52 across pocket slot 38 to panel 24. If desired, pocket facing strip 46 can then be laid over welts 44 and 52, and the remaining portion of pocket slot 38. Depending upon the width of second welt 52, it may be necessary to first position adhesive strip 54 between welt 52 and facing strip 46 to provide for later sealing of the upper pocket construction. It will be apparent that the purpose of adhesive strip 54 could also be served by the initial provision of adhesive areas (not shown) at the appropriate locations on either second welt 52 or facing strip 46, if desired. As is best shown in FIG. 13, it will be appreciated that either adhesive strip 40 or adhesive strip 54 can be provided with sufficient width to secure the upper end of pocket panel 26 to inner panel 24 and/or the inside of garment 30. An optional stitch 55 can be added for reinforcement. Stitch 55 is similar to optional stitch 45, but is utilized to interconnect second welt 52, the upper half of flap set 36, and inner panel 24. Stitch 55 preferably extends along substantially the entire width of pocket slot 38. After positioning of welts 44 and 52, and facing strip 46, stitched bar tacks 50 are added to mechanically interconnect the desired components, inner panel 24 and garment 30. Panel 26 is then closed and sealed in the usual manner to complete the pocket construction. Consequently, it will be understood that the method of the invention can be utilized to construct pockets having double welts.

Figure 14:
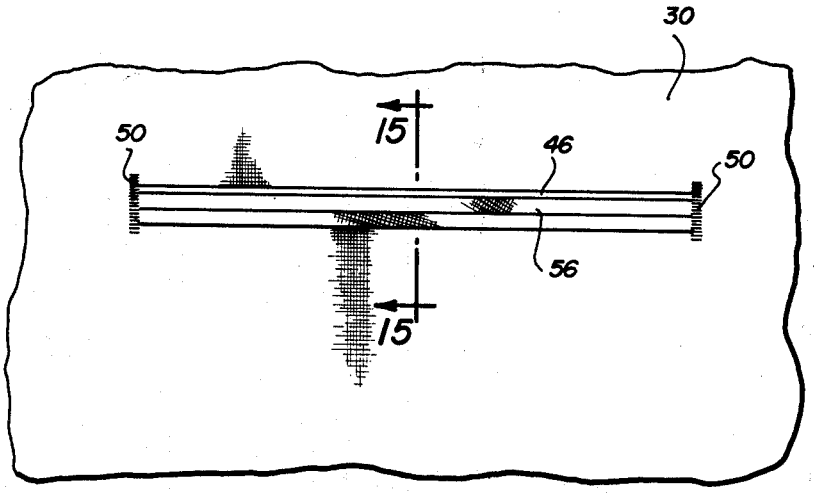
FIG. 14 is an illustration of the outside surface of a garment having a pocket formed in accordance with a second modification of the invention.
Figure 15:
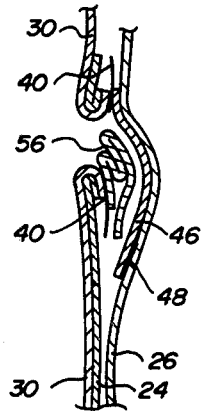
FIG. 15 is a partial sectional view taken generally along lines 15—15 in FIG. 14.

Referring to FIGS. 14 and 15, there is shown a simulated double welt 56 which can be incorporated into the invention. In place of single welt 44, welt 56 can be laid over adhesive strip 40 across the lower edge of pocket slot 38. Simulated double welt 56 comprises a length of suitable material folded so as to give the appearance of a double welt construction. As is best shown in FIG. 15, simulated double welt 56 achieves this purpose by being folded and flattened in an uneven W configuration. No additional adhesive strips are required when using welt 56. After the positioning of simulated double welt 56, the fusible material comprising adhesive strip 40 is then activated to secure welt 56 to panel 24 across pocket slot 38. An optional stitch 57 can be added for reinforcement. Stitch 57 is similar to stitch 45, and is utilized to interconnect double welt 56, the lower half of flap set 36, and inner panel 24. Stitch 57 preferably extends along substantially the entire width of pocket slot 38. If desired, pocket facing strip 46 can then be laid over welt 56 and the remaining portion of pocket slot 38, followed by the placement of stitched bar tacks 50. Panel 26 can then be closed and sealed in the usual manner. Consequently, it will be understood that the method of the invention can be utilized to construct a simulated double welt pocket.

Figure 16:
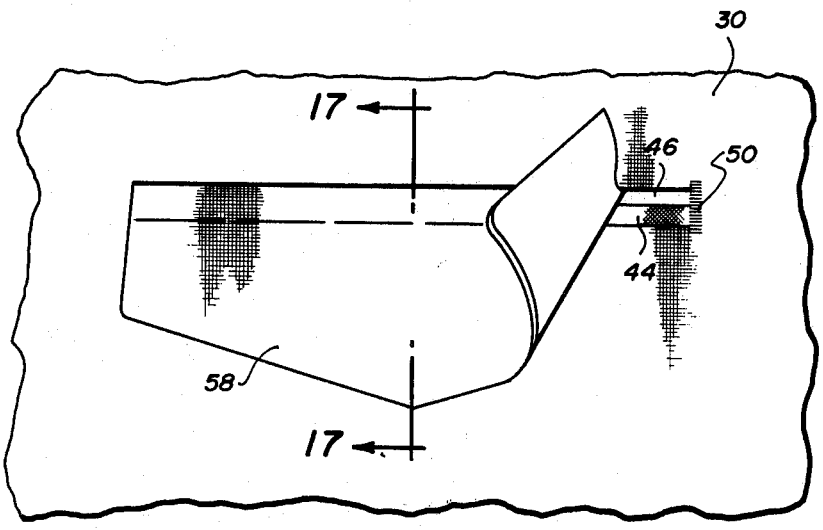
FIG. 16 is an illustration of the outside surface of a garment having a pocket formed in accordance with a third modification of the invention.
Figure 17:
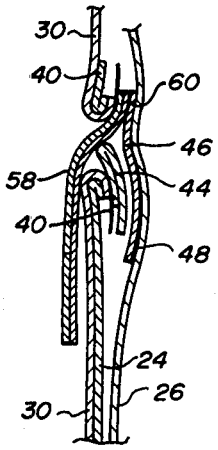
FIG. 17 is a partial sectional view taken generally along lines 17—17 in FIG. 16.

With reference now to FIGS. 16 and 17, placement of pocket flap 58 can be incorporated in the method of the invention. The width of flap 58 is such that it can be positioned within pocket slot 38. Flap 58 can be utilized with or without welt 44 and/or facing strip 46. Preferably, flap 58 is utilized in conjunction with welt 44 and facing strip 46. Either before or after the placement of welt 44, flap 58 is positioned within the pocket slot 38 so that the upper end of flap 58 overlays adhesive strip 40 adjacent the upper side of slot 38. The fusible material comprising adhesive strip 40 is activated to secure flap 58 to panel 24. An optional stitch 59 can be added for reinforcement. Stitch 59 is similar to stitch 45, but is utilized to interconnect flap 58, the upper half of flap set 36, and inner panel 24. Stitch 59 preferably extends along substantially the entire width of pocket slot 38. If desired, facing strip 46 can then be laid over the upper end of flap 58, welt 44, and over the remaining portion of pocket slot 38. Adhesive strip 60 is positioned between the upper end of flaps 58 and facing strip 46 to provide a means for sealing the upper end of the pocket construction. It will be appreciated that adhesive areas (not shown) can be provided initially at the appropriate locations on flap 58 and/or facing strip 46 to function in place of adhesive strip 60, if desired. Stitched bar tacks 50 are then added at each end of slot 38 to mechanically interconnect garment 30, panel 24, and the desired pocket components. It will be understood that tacks 50 do not extend through flap 58. Following formation of tacks 50, panel 26 is closed and the remaining adhesive areas are secured to seal the upper section of the pocket construction. Consequently, it will be understood that the method of the invention can also be utilized to construct pockets having flaps.

The pocket construction method described above and illustrated in FIGS. 1–17 comprises a first embodiment of the invention which is particularly suited for fabricating back pockets in trousers, or other types of pockets which are located within a garment panel and away from the periphery thereof. The method illustrated in FIGS. 1–17 is not especially desirable for front-type pockets. On the other hand, the pocket construction method shown in FIGS. 18–33 represents a second embodiment of the invention which is suitable for front trouser pockets or other pockets which may be located on a seam at the edge of a garment panel.

Figure 18:
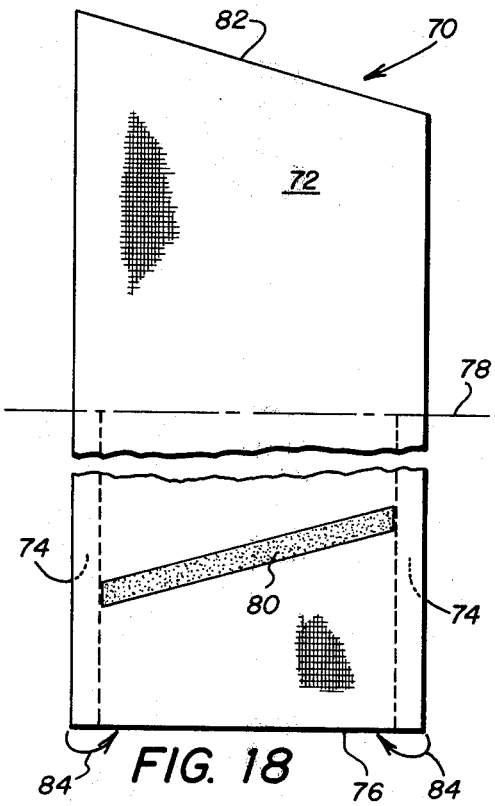
FIGS. 18 and 19 are illustrations of a pocket blank useful in a method of constructing pockets according to a second embodiment of the invention.
Figure 19:
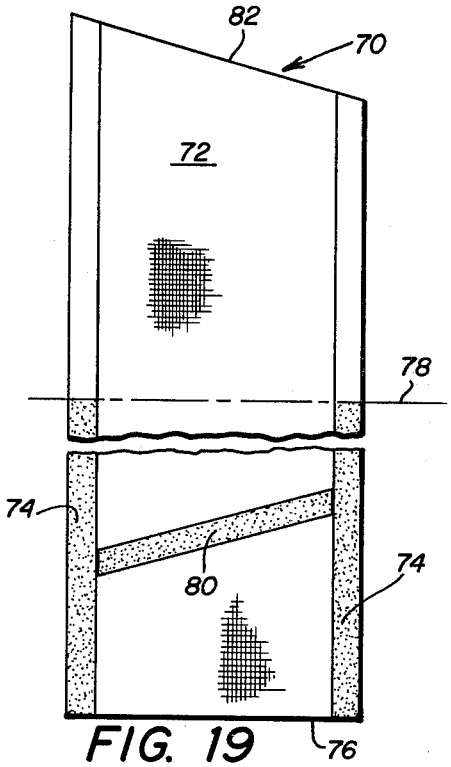

FIGS. 18 and 19 show a pocket blank 70 useful in practicing the second embodiment of the invention herein. Pocket blank 70 is illustrated in a flat, unfolded initial condition with the reverse side up in FIG. 18. Pocket blank 70 is defined by a generally rectangular length of pocket material 72 of sufficient size to permit fabrication of the desired pocket. Material 72 can comprise any suitable natural or synthetic cloth material, the exact composition of which is not critical to the invention.

Adhesive areas 74 are located alongside part of both longitudinal edges of the reverse side of material 72. Adhesive areas 74 are of predetermined width and extend from lower end 76 at least to transverse fold line 78 on material 72. Preferably, pocket blank 70 also includes a generally transverse adhesive area 80 extending diagonally across the reverse side of material 72. The upper end 82 of pocket blank 70 is also angled or cut diagonally as will be explained more fully hereinafter.

Adhesive areas 74 and 80 can be formed by attaching thin layers of fusible adhesive material to pocket blank 70 in the desired locations, in a fashion similar to that described with regard to pocket blank 10. The fusible material is preferably thermally responsive and may comprise ribbons or strips of extended polyamide, nylon or polyester materials of the type manufactured by General Fabric Fusing Company of Cincinnati, Ohio. If desired, fusible adhesive can be extruded directly onto pocket material 72.

As indicated by arrows 84 in FIG. 18, the longitudinal edges of pocket blank 70 are turned inwardly so that adhesive areas 74 face the same direction as adhesive area 80. FIG. 19 shows pocket blank 70 after folding the longitudinal edges thereof. It will thus be apparent that pocket blank 70 is substantially similar to pocket blank 10 utilized in the first embodiment of the invention, except that adhesive area 80 and upper end 82 are diagonally rather than perpendicularly oriented with respect to the sides of the pocket blank.

Figure 20:
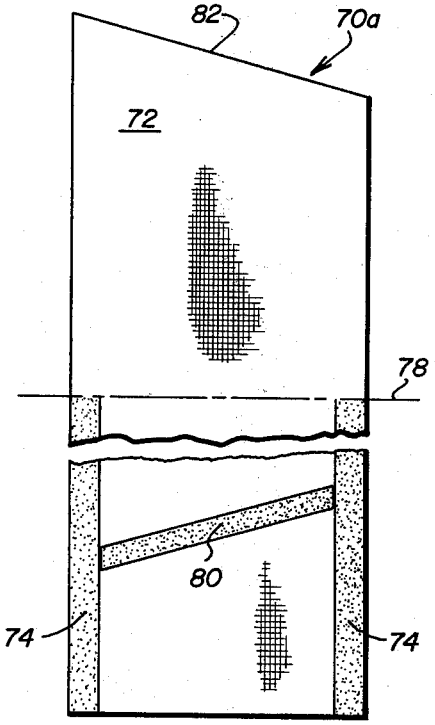
FIG. 20 is an illustration of an alternative to the pocket blank shown in FIGS. 18 and 19.

Referring to FIG. 20, there is shown a pocket blank **70*a* which may be used as an alternative to pocket blank 70. In pocket blank 70*a*, adhesive areas 74 are provided on the same side of pocket blank 72 as adhesive area 80, rather than the opposite side thereof. This eliminates the step of inwardly folding the longitudinal edges of material 72 but results in a pocket of somewhat less finished appearance by reason of the exposed edges. It will thus be apparent that pocket blank 70*a* is substantially similar to pocket blank 10*a* shown in FIG. 10, except that adhesive area 80 and upper end 82** are diagonally rather than perpendicularly oriented with respect to the side of the pocket blank.

Figure 21:
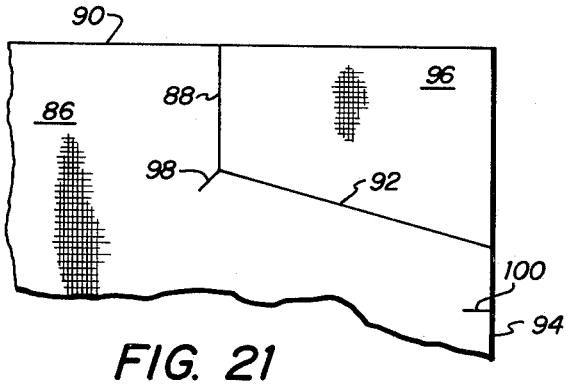
Figure 22:
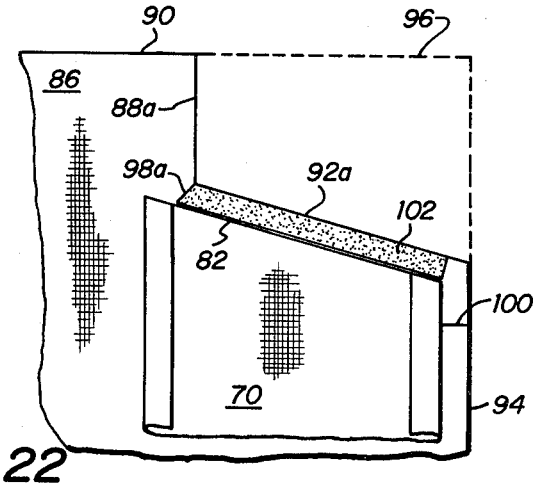

Referring to FIGS. 21 and 22, a garment panel 86 wherein a pocket is desired is prepared to receive pocket blank 70. The material of garment panel 86 can comprise any suitable natural or synthetic fabric, the composition of which is not critical to the invention. Garment panel 86 is shown with the inside surface up and can comprise, for example, a left or right front trousers panel.

To prepare garment panel 86, a pocket opening is formed in one corner thereof. As illustrated, a slit or cut 88 of predetermined length is made inward from top edge 90 of panel 86. Another slit or cut 92 extends from the end of cut 88 to side edge 94 of panel 86 so that piece 96 can be removed therefrom. Preferably, a small cut 98 is made at the junction of cuts 88 and 92 so that the edges of panel 86 defined thereby can be folded back. In addition, another small cut 100 is preferably made in side edge 94 below cut 92 so that a portion of the side edge can be folded inwardly. Piece 96 is then removed and discarded or utilized for belt loop construction, as desired.

The pocket blank 70 and an adhesive strip 102 are then positiobned on the inside surface of garment panel 86, as shown in FIG. 22. Upper end 82 of pocket blank 70 is positioned beneath edge **92*a* previously formed by cut 92. Adhesive strip 102 is then placed on garment panel 86 between edge 92*a* and end 82 of pocket blank 70. Adhesive strip 102 preferably consists of a piece of extruded fusible adhesive material carried on a backing layer (not shown). By this means, strip 102 can be positioned on garment panel 86 and partially activated through the backing layer to secure it in place. The backing layer (not shown) can then be peeled away to expose the outside of adhesive strip 102**.

Referring to FIG. 23, the edge **88*a*, edge 92*a*, and that portion of garment panel edge 94 above cut 100 are then folded inwardly. Preferably, that portion of right edge 94 is folded inwardly against pocket blank 70 before edge 92*a* and adhesive strip 102 are folded thereover. Adhesive strip 102 is then activated to bond pocket blank 70 to garment panel 86. Activation of the adhesive may be accomplished, for example, with a heated press or other means capable of converting the adhesive from a solid state to a plastic state as previously explained herein with regard to the first inventive embodiment illustrated in FIGS. 1–17. Pocket blank 70 is thus adhesively secured at the upper end thereof to garment panel 86**.

An optional reinforcing stitch 104 can be added for purposes of reinforcment. Stitch 104 extends alongside the lower edge of pocket opening 106 and interconnects pocket blank 70 and garment panel 86. Stitch 104 preferably extends through the outside surface of garment panel 86 to lend a handmade appearance to the garment.

Before pocket blank 70 is folded about fold line 78 and closed, a facing strip 108 is attached to the pocket blank in accordance with the preferred practice of the invention. Facing strip 108 is secured to pocket blank 70 by means of adhesive area 80, and is dimensioned to cover pocket opening 106 after closing and sealing the pocket blank. Facing strip 108 preferably extends across pocket blank 70 between the inwardly folded edge portions thereof and may extend beneath the folded edge portions. It will be understood that facing strip 108 does not cover adhesive areas 74 and is adhesively secured by adhesive area 80 to pocket blank 70 at the lower end of the facing strip only.

Referring to FIGS. 24–26, a second garment panel 110 is preferably joined to garment panel 86 before pocket blank 70 is closed and sealed. Garment panels 86 and 110 are interconnected in conventional fashion by stitching 112 joining edge 94 of garment panel 86 and edge 114 of panel 110 to form a plain seam. Pocket blank 70 is then folded to position facing strip 108 over pocket opening 106 and close the pocket. Preferably, stitching 112 extends upwardly to interconnect facing strip 108 and second garment panel 110 as can be seen in FIG. 26. The pocket is sealed by securing the edges of the transversely folded pocket blank 70.

Adhesive areas 74 are utilized to secure the folded pocket blank 70 to garment panel 86. The upper portion of left adhesive area 74 adhesively interconnects pocket blank 70 and the folded back edge portion **88*a* of garment panel 86. The upper portion of right adhesive area 74 adhesively interconnects pocket blank 70 with the edge of facing strip 108, which is secured to garment panel 86 by seam 112 as shown in FIG. 26**.

In the alternative, as shown in FIG. 27, the upper portion of right adhesive area 74 can be employed to adhesively connect pocket blank 70 to the folded back edge 114 of garment panel 110. One side of folded pocket blank 70 would thus cover a portion of seam 113 to improve the interior finish of the garment.

Referring again to FIG. 24, stitched bar tacks 116 are provided next through both layers of pocket blank 70, and edge portion 92*a* of garment panel 86. The bar tacks 116 are located at each end of edge portion 92*a* as can be seen best in FIG. 28. The various components of the pocket are thus mechanically interconnected by bar tacks 116, which may also comprise staples, rivets or other suitable adhesive if desired. Bar tacks 116 thus function to reinforce the pocket construction and further serve to lend a handmade appearance to the garment. A waistband of conventional construction is ultimately added over the upper end of closed pocket blank 70 and across the upper edges of panels 86 and 110 in finishing construction of the garment, which has been described as a pair of trousers for purposes of illustration here.

FIG. 28 illustrates a partial front view of trousers 118 incorporating garment panels 86 and 110 with a pocket construction in accordance with the second embodiment of the invention. The pocket in trousers 118 is a western-type pocket. Pocket opening 106 is defined by facing strip 108 in conjunction with the folded, adhesively secured and stitched portions of garment panel 86. A waistband 120 extends across the tops of panels 86 and 110. A right front trousers pocket is shown for illustrative purposes in FIG. 28; however, it will be understood that the inventive method described herein can be utilized to construct left front trouser pockets as well.

Figure 29:
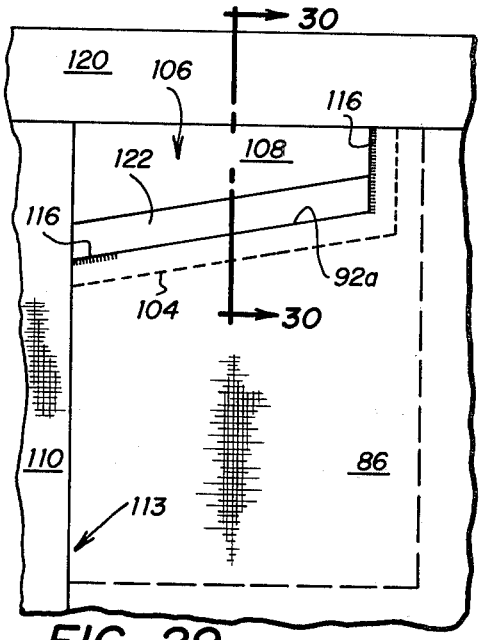
Figure 30:
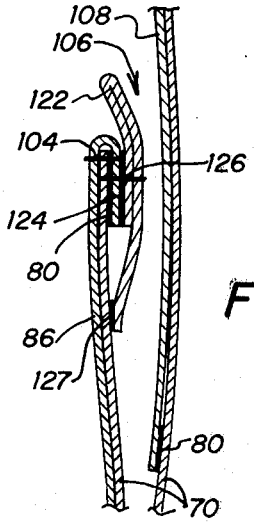

With reference to FIGS. 29 and 30, there is shown a first modification of the pocket constructed according to the second embodiment of the invention. The pocket illustrated is basically the pocket shown in FIG. 28 except that the cut defining the lower edge of the pocket opening 106 is not notched, but extends straight to the seam 112 between panels 86 and 110. The modification shown in FIGS. 29 and 30 includes the addition of pocket welt 122 which is of substantially similar construction to welt 44 utilized in the first inventive embodiment herein. Welt 122 is positioned on the inside of folded edge portion 92*a* and adhesively secured thereto by means of adhesive strip 124 before provision of stitching 126 therethrough, closure of pocket blank 70 and provision of bar tacks 116 therethrough. Preferably, the lower edge of welt 122 is secured to the inner pocket panel of pocket blank 70 with an adhesive strip 127. The method of constructing pockets according to the second embodiment of the invention can thus be readily modified to generate a welted front pocket construction.

Figure 31:
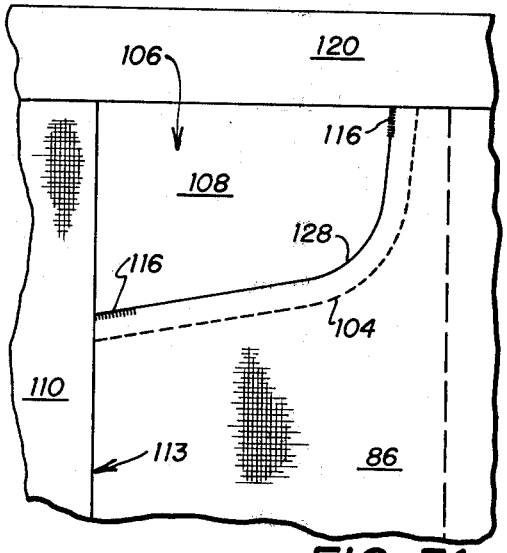
FIGS. 29-33 are illustrations showing modifications of the second embodiment of the invention.
Figure 32:
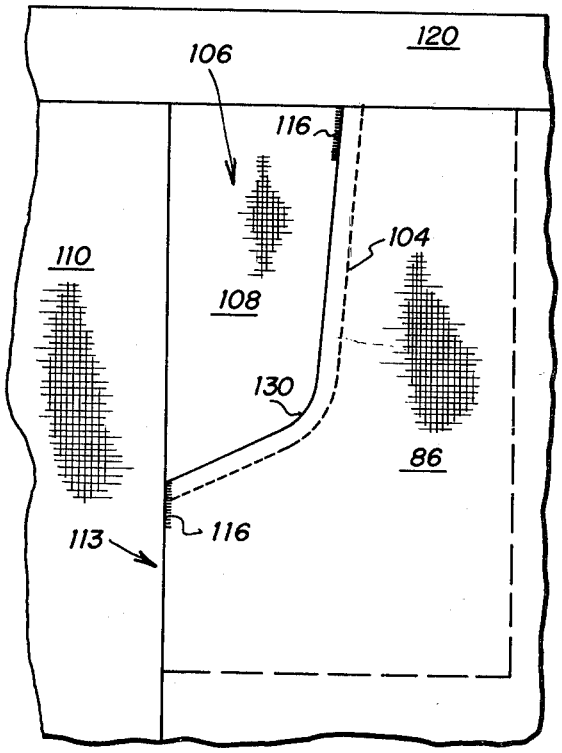
Figure 33:
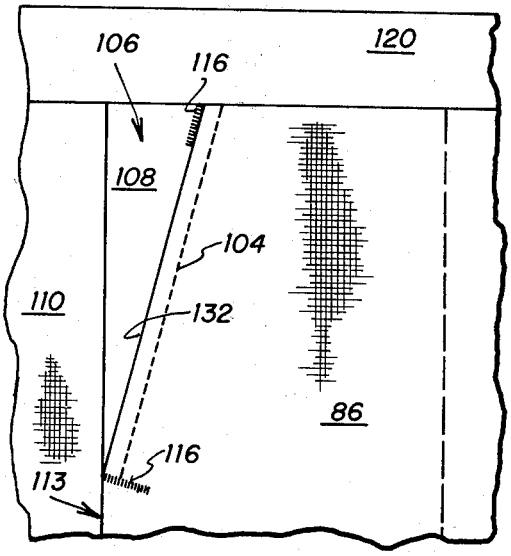

FIGS. 31–33 show three other types of front pockets which can be constructed by the method comprising the second embodiment of the invention. The configuration of the folded edge portion of garment panel 86 which defines the shape of the pocket opening is the only difference between these three types of pockets. FIG. 31 shows a scoop type pocket wherein the edge portion 128 is curved rather than angular. FIG. 32 shows another form of scoop pocket in which the edge portion 130 of garment panel 86 is J-shaped. FIG. 33 shows a slash type pocket wherein the edge portion 128 extends in a straight line across one corner of garment panel 86. It will be understood that each of these pockets can be constructed simply by forming the particular pocket opening desired into garment panel 86 and otherwise proceeding in all other respects under the pocket construction method comprising the second embodiment of the invention.

From the foregoing, it will be understood that the present invention comprises a method of constructing pockets which incorporates numerous advantages over the prior art. One important advantage deriving from the method of the invention involves the fact that numerous manual operations which were heretofore required in the construction of pockets have been eliminated. Other important benefits derive from the extensive use of fusible materials in the construction process. A further advantage is the fact that all steps of the method, including the steps of adhesively securing sections of the pocket by activation of fusible materials, are performed from the inside of the garment so that the outside surface of the garment is protected from damage. Other advantages deriving from the use of the invention will readily suggest themselves to those skilled in the art.

Although particular embodiments of the invention have been illustrated in the accompanying Drawings and described in the foregoing Detailed Description, it will be understood that the application is not limited to the embodiments disclosed, but is intended to embrace any alternatives, modifications, rearrangements and substitutions of parts and elements as fall within the spirit and scope of the invention.

I claim:

1. In a pocket construction method of the type wherein a generally rectangular pocket blank is connected to a garment panel adjacent to a pocket opening formed by removal of a corner of the garment panel, said pocket blank being transversely folded to form inner and outer pocket panels with a facing strip connected to said pocket blank, said pocket panels being secured along the longitudinal edges thereof to seal the pocket, the improvement comprising the steps of:

folding a portion of the garment panel defining said pocket opening backwardly over a portion of the pocket blank;

adhesively securing the pocket blank to said garment panel;

positioning the facing strip adjacent to the outer pocket panel such that the pocket opening in the garment panel is covered when the pocket blank is folded transversely; and securing said facing strip to said outer pocket panel.

2. The improvement according to claim 1, wherein the step of securing the facing strip to the outer pocket panel is characterized by the use of adhesive to effect adhesive interconnection.

3. The improvement according to claim 1, wherein the pocket blank includes a generally transverse strip of fusible adhesive material attached to one side thereof, and wherein the step of securing the facing strip to the outer pocket panel is accomplished by activating said adhesive strip.

4. The improvement according to claim 1, including the step of:

providing a stitch adjacent to the pocket opening extending through the garment panel, facing strip and at least one of the pocket panels to reinforce the pocket.

5. The pocket constructed according to the improved method of claim 1.

6. A method of constructing a pocket in a garment panel with a generally rectangular pocket blank, comprising the steps of:

forming a pocket opening in the garment panel;

positioning the pocket blank on the garment panel with one end of said blank adjacent to said pocket opening;

folding a portion of the edge of the garment panel defining the pocket opening backward over a portion of the pocket blank, adhesively securing the pocket blank to the garment panel;

transversely folding the pocket blank to form inner and outer pocket panels interconnected by a fold at one end thereof; and interconnecting the pocket panels along the longitudinal edges thereof to complete construction of the pocket.

7. The method of claim 6, wherein the step of forming a pocket opening in the garment panel comprises the step of:

removing a corner from said garment panel, said corner being defined by intersecting top and side panel edges.

8. The method of claim 6, wherein the step of adhesively securing the pocket blank to the garment panel comprises the steps of:

placing adhesive material between the pocket blank and the edge portion of the garment panel folded thereover; and activating said adhesive material to effect adhesive connection.

9. The method according to claim 8, wherein the adhesive material is selected from the group consisting of nylon, polyester and polyamide materials.

10. The method of claim 6, including the step of:

providing a stitch adjacent to the pocket opening extending through the garment panel and at least one of the pocket panels to reinforce the pocket construction.

11. The method of claim 6, including the step of:

placing a facing strip behind the pocket opening in the garment panel and adjacent to the outer pocket panel; and securing the facing strip to the outer pocket panel.

12. The method of claim 6, including the steps of:

placing a pocket welt within the pocket opening and adjacent to the folded over portion of the garment panel; and securing said pocket welt to said garment panel.

13. The pocket constructed according to the method of claim 6.

14. A method of constructing a pocket in a garment panel with a pocket blank, comprising the steps of:

forming a predetermined pocket opening in the garment panel, said opening being defined by at least one edge of said garment panel;

positioning the pocket blank on the inside surface of said garment panel with one end of said blank adjacent to the pocket opening formed therein;

folding an edge of said garment panel defining the pocket opening backwardly over a portion of the pocket blank;

adhesively interconnecting the pocket blank and garment panel;

positioning a facing strip behind the pocket opening formed in said garment panel;

transversely folding the pocket blank to form inner and outer pocket panels with said facing strip located adjacent to said outer pocket panel;

securing the facing strip to the outer pocket panel; and interconnecting the inner and outer pocket panels along the longitudinal edges thereof to complete construction of the pocket.

15. The method of claim 14, wherein the step of adhesively securing the pocket blank to the garment panel comprises the steps of:

placing adhesive material between the pocket blank and the edge portion of the garment panel folded thereover; and activating said adhesive material to effect adhesive interconnection between the pocket blank and garment panel.

16. The method according to claim 14, wherein the adhesive material is selected from the group consisting of nylon, polyester and polyamide materials.

17. The method of claim 14, including the step of:

providing a stitch adjacent to the pocket opening and extending through the garment panel and at least one of the pocket panels to reinforce the pocket.

18. The method of claim 14, including the steps of:

placing a pocket welt within the pocket opening and adjacent to the folded over portion of the garment panel; and securing said pocket welt to said garment panel.

19. The method of claim 14, including the step of:

inwardly folding the longitudinal edges of the pocket blank before the transverse folding step so that said edges are inside the completed pocket.

20. The pocket constructed according to the method of claim 14.

21. In a pocket construction method of the type wherein a generally rectangular pocket blank is connected to a garment panel adjacent to a pocket opening formed by removal of a corner of the garment panel, said pocket blank being transversely folded to form inner and outer pocket panels and being secured along the longitudinal edges of the pocket panels to seal the pocket, the improvement comprising the steps of:

folding a portion of the garment panel defining said pocket opening backwardly over a portion of the inner pocket panel; and adhesively securing the inner pocket panel of the pocket blank to the garment panel.

22. The improvement according to claim 21, including the steps of:

providing a facing strip;

positioning the facing strip between the pocket panels such that the pocket opening in the garment panel is covered when the pocket blank is transversely folded; and securing the facing strip to the outer pocket panel.

23. The improvement according to claim 22, wherein the step of securing the facing strip to the outer pocket panel is characterized by the use of adhesive to effect adhesive interconnection.

24. The improvement according to claim 22, wherein the pocket blank includes a generally transverse strip of fusible adhesive material attached to one side thereof, and wherein the step of securing the facing strip to the outer pocket panel is accomplished by activating said adhesive strip.

25. The improvement according to claim 21, including the step of:

providing a stitch along the pocket opening extending through the garment panel and at least one of the pocket panels to reinforce the pocket construction.

26. The pocket constructed according to the improved method of claim 21.

27. A pocket construction, comprising:

a garment panel;

said garment panel having a pocket opening formed by removal of a corner of the garment panel;

a length of material defining a pocket blank;

said pocket blank being positioned adjacent to the pocket opening in said garment panel and being folded transversely into inner and outer pocket panels interconnected at the lower ends by a fold;

means located along a portion of the pocket opening for adhesively interconnecting the inner pocket panel and said garment panel; and means for securing the top ends and longitudinal edges of the pocket panels to complete construction of the pocket.

28. The pocket construction of claim 27, wherein the longitudinal edges of the pocket blank are folded inside the inner and outer pocket panels before being secured.

29. The pocket construction of claim 27, wherein said means for adhesively interconnecting the inner pocket panel and garment panel comprises:

a portion of said garment panel bordering the pocket opening being folded over the top end of the inner pocket panel; and fusable adhesive material disposed between the folded portion of said garment panel and the inner pocket panel for securing said pocket blank to said garment panel.

30. The pocket construction of claim 27, further including:

stitch means extending through said garment panel and at least one of the pocket panels for reinforcing the pocket construction.

31. The pocket construction of claim 27, further including:

a facing strip positioned between the inner and outer pocket panels and behind the pocket opening in said garment panel; and means for securing said facing strip to the outer pocket panel.

32. The pocket construction of claim 27, further including:

a welt positioned inside the pocket opening; and means for securing said welt to the inner pocket panel and garment panel.

33. A pocket construction, which comprises:

a garment panel with a pocket opening formed therein;

a length of material defining a pocket blank;

said pocket blank being positioned adjacent to the pocket opening in said garment panel and being folded transversely into inner and outer pocket panels interconnected by a fold at the lower ends;

means for adhesively interconnecting the inner pocket panel and garment panel along a portion of the pocket opening;

a facing strip positioned behind the pocket opening and between the inner and outer pocket panels;

means for securing said facing strip to the outer pocket panel; and means for securing the top ends and longitudinal edges of the pocket panels to complete construction of the pocket.

34. The pocket construction of claim 33, wherein the longitudinal edges of the pocket blank are folded inside the inner and outer pocket panels before being secured.

35. The pocket construction of claim 33, wherein said means for adhesively interconnecting the inner pocket panel and garment panel comprises:

a portion of said garment panel bordering the pocket opening being folded over the top end of the inner pocket panel; and fusible adhesive material disposed between the folded portion of said garment panel and the inner pocket panel for securing said pocket blank to said garment panel.

36. The pocket construction of claim 33, further including:

stitch means extending through said garment panel and at least one of the pocket panels for reinforcing the pocket construction.

37. The pocket construction of claim 33, further including:

a welt positioned inside the pocket opening; and means for securing said welt to the inner pocket panel and garment panel.

* * * * *

UNITED STATES PATENT AND TRADEMARK OFFICE

CERTIFICATE OF CORRECTION

PATENT NO. : 4,321,710
DATED : March 30, 1982
INVENTOR(S) : JOSEPH W. A. OFF

It is certified that error appears in the above-identified patent and that said Letters Patent are hereby corrected as shown below:

Column 1, line 30, "path" should read -- patch --.
Column 4, line 36, "an" should be --the--;
Column 5, line 27, "preferably" should be --preferable--;
Column 8, line 39, "flaps 58" should be --flap 58--;
Column 9, line 22 "extended" should be --extruded--;
Column 10, line 4 "positiobned" should be --positioned--;
Column 10, line 16, after "23", delete "the";
Column 10, line 31, "reinforcment" should be --reinforcement--.

Signed and Sealed this

*Twenty-second* Day of *June 1982*

[SEAL]

*Attest:*

GERALD J. MOSSINGHOFF

*Attesting Officer*

*Commissioner of Patents and Trademarks*